US006179015B1

(12) United States Patent
Kammler et al.

(10) Patent No.: US 6,179,015 B1
(45) Date of Patent: Jan. 30, 2001

(54) DEVICE AND METHOD FOR PACKAGING

(75) Inventors: Roman Kammler, Worms; Georg Koppenwallner, Katlenburg/Lindau; Walter Baur, Gruendau, all of (DE)

(73) Assignee: Rovema Verpackungsmaschinen GmbH, Fernward (DE)

( * ) Notice: Under 35 U.S.C. 154(b), the term of this patent shall be extended for 0 days.

(21) Appl. No.: 09/438,267

(22) Filed: Nov. 10, 1999

(30) Foreign Application Priority Data

Nov. 12, 1998 (DE) ..... 198 52 107

(51) Int. Cl.[7] ..... B65B 31/00; B67C 3/00

(52) U.S. Cl. ..... 141/4; 141/5; 141/8; 141/62; 141/65; 141/67; 141/59; 141/94; 53/403; 53/510

(58) Field of Search ..... 141/2, 4, 5, 7, 141/8, 12, 48, 62, 63, 65, 67, 89–94, 116, 126, 59; 53/403, 510

(56) References Cited

U.S. PATENT DOCUMENTS

| | | | |
|---|---|---|---|
| 3,040,490 | 6/1962 | Virta . | |
| 3,482,373 | 12/1969 | Morris . | |
| 3,528,214 | 9/1970 | Calvano . | |
| 3,579,945 | 5/1971 | Buchner et al. . | |
| 3,664,086 | 5/1972 | James et al. . | |
| 4,738,287 | 4/1988 | Klinkel . | |
| 4,964,259 | 10/1990 | Ylvisaker et al. . | |
| 4,974,646 * | 12/1990 | Martin et al. | 141/67 |
| 4,976,296 * | 12/1990 | Pope | 141/46 |
| 5,598,876 * | 2/1997 | Zanini et al. | 141/93 |
| 6,116,001 | 9/2000 | Kammler et al. . | |

FOREIGN PATENT DOCUMENTS

| | | |
|---|---|---|
| 192 604 | 11/1906 | (DE) . |
| 2 017 401 | 10/1971 | (DE) . |
| 3 325 300 | 2/1984 | (DE) . |
| 0 192 604 | 8/1986 | (EP) . |
| 50-83980 | 10/1975 | (JP) . |

* cited by examiner

*Primary Examiner*—Timothy L. Maust
(74) *Attorney, Agent, or Firm*—Flynn, Thiel, Boutell & Tanis, P.C.

(57) ABSTRACT

In order to further accelerate a pourable product (4) falling into a fill pipe (2) or in order to compress the particle cluster of the product (4), it is suggested to blow air in timed intervals into the fill pipe (2). An air flap (13) is operated for this purpose in a pipe (11) between a blower (10) and the fill pipe (2) by means of a drive 14. A control device (15) controls the drive (14) dependent on a packaging parameter, for example, at a point in time when the product (4) is in a position of the free fall, which position is recognized by a sensor (16).

15 Claims, 3 Drawing Sheets

DEVICE AND METHOD FOR PACKAGING

CROSS REFERENCE TO RELATED APPLICATIONS

The subject matter of this application is related to the subject matter disclosed in U.S. Ser. No. 09/185 781, filed Nov. 4, 1998, now U.S. Pat. No. 6,116,001, issued Sep. 12, 2000, and U.S. Ser. No. 09/390,919, filed Sep. 7, 1999.

FIELD OF THE INVENTION

The invention relates, on the one hand, to a device for packaging a filler material, and particularly to such device including a vertical fill pipe, a funnel above the fill pipe, a format pipe concentrically surrounding the fill pipe, wherein between the fill pipe and the format pipe there is provided an annular gap, a blower for blowing air into the fill pipe and for influencing the falling product in the fill pipe, wherein the blower is connected to the fill pipe through a pipe for supplying the air, and a suction device for sucking the air out of the fill pipe. The invention relates, on the other hand, to a method for operating such a device.

BACKGROUND OF THE INVENTION

A blower is used in a conventional device or a conventional method of this type in order to produce a downwardly directed air stream in a fill pipe of a packaging machine in order to apply additional acceleration to a free falling, pourable product portion, and in this manner to shorten the falling time and to increase the packaging speed. The air stream is guided from the lower end of the fill pipe into the annular gap and from there upwardly out of the format pipe. The blower is used at its suction side as a suction device so that a circulating air stream is achieved. The air stream is continuous, namely a permanent air stream is provided.

The conventional device and the conventional method have the disadvantage that only a uniform influence can be applied to a falling cluster of particles. Thus, the cluster lead at the bottom experiences the same air stream as the upper cluster end, thus the cluster length cannot be influenced. The cluster length, however, is just as important for the filling time as the falling time. A short compact particle cluster can be filled more quickly than a longer one. In addition, a specific cluster length can be advantageous for a specific packaging sequence.

SUMMARY OF THE INVENTION

The basic purpose of the invention is to vary the length of the particle cluster of an additionally downwardly accelerated product portion.

In the device of the present invention, there is provided an air flap within the pipe for feeding of air into the fill pipe, the air flap can be operated by means of a drive, and the drive is connected to a control device. In the method of the present invention, a timed air stream is supplied to the fill pipe by operating the air flap, or the air flap is adjusted to an air passage position in order to supply a continuous air stream to the fill pipe.

The invention has the advantage that the length of the particle cluster can be varied through the timed supply of air. Thus, it is possible, on the one hand, to design the particle cluster either as compact as possible so that the filling time is as short as possible, or to change the particle cluster to a different desired length. An air stream impulse can run ahead of the falling product in the fill pipe, can superpose itself over the particle cluster, and can act behind the product. Also combinations thereof are possible and practical. When an air stream impulse runs ahead of a particle cluster, it can compress the lead portion of the particle cluster due to a pressure imbalance and can slightly lengthen its end portion. When it acts after a particle cluster, then it compresses first of all its end portion, and the entire particle cluster all together. The air flap can be operated through the control device in such a manner that depending on the type of product (for example potato chips or a granular product), the mass of a product portion, and the machine performance, a favorable filling operation takes place.

When the blower and the suction device can be operated separately from one another, then it is possible to operate the suction device differently than the blower in order to apply at specific times an additional action on a particle cluster. Or the suction device is continuously operated, which minimizes the technical control in the packaging device required for controlling the suction device.

When the pipe of the pressure air supply ends in an annular nozzle, which is provided between the funnel and the fill pipe, then it is possible to produce an air impulse way at the top in the fill pipe in order to act in this manner downwardly along as large a path as possible, and to accelerate the product well.

The air can be sucked off with a good performance through a suction chamber on the fill pipe, which is connected to the annular gap through openings in the fill pipe. This technique is also suited for vertical tubular bagging machines when its foil tube and its forming shoulder are provided below the openings. Thus, the foil transport is not influenced by the suction chamber.

When a sensor for recognizing the falling product is provided in the fill pipe, preferably directly below the annular nozzle, then it is possible to recognize the start and end of a particle cluster in the fill pipe. The device can in this manner be operated more exactly, or the function of a scale or a packaging machine drive can be adapted better to the device and product, through which improved filling performances can be achieved.

When the product is filled into a foil tube, and when the air flap and/or the suction device are operated dependent on the pressure desired in the lower end of the foil tube, it is possible to manufacture the tubular bag with a specific inside pressure, which protects easily breakable product filled in the tubular bag. The flap can in addition be opened at various widths in order to produce an exact pressure.

Varying effects on a particle cluster of a pourable product can be applied by suitably controlling the blower, the air flap, and/or the suction device. It is hereby sensible in some cases to supply stored empirical values to the control device in order to achieve an optimum operation of the device.

BRIEF DESCRIPTION OF DRAWINGS

The invention will be described in greater detail hereinafter in connection with one exemplary embodiment and the drawings, in which.

DETAILED DESCRIPTION

Figure 1:
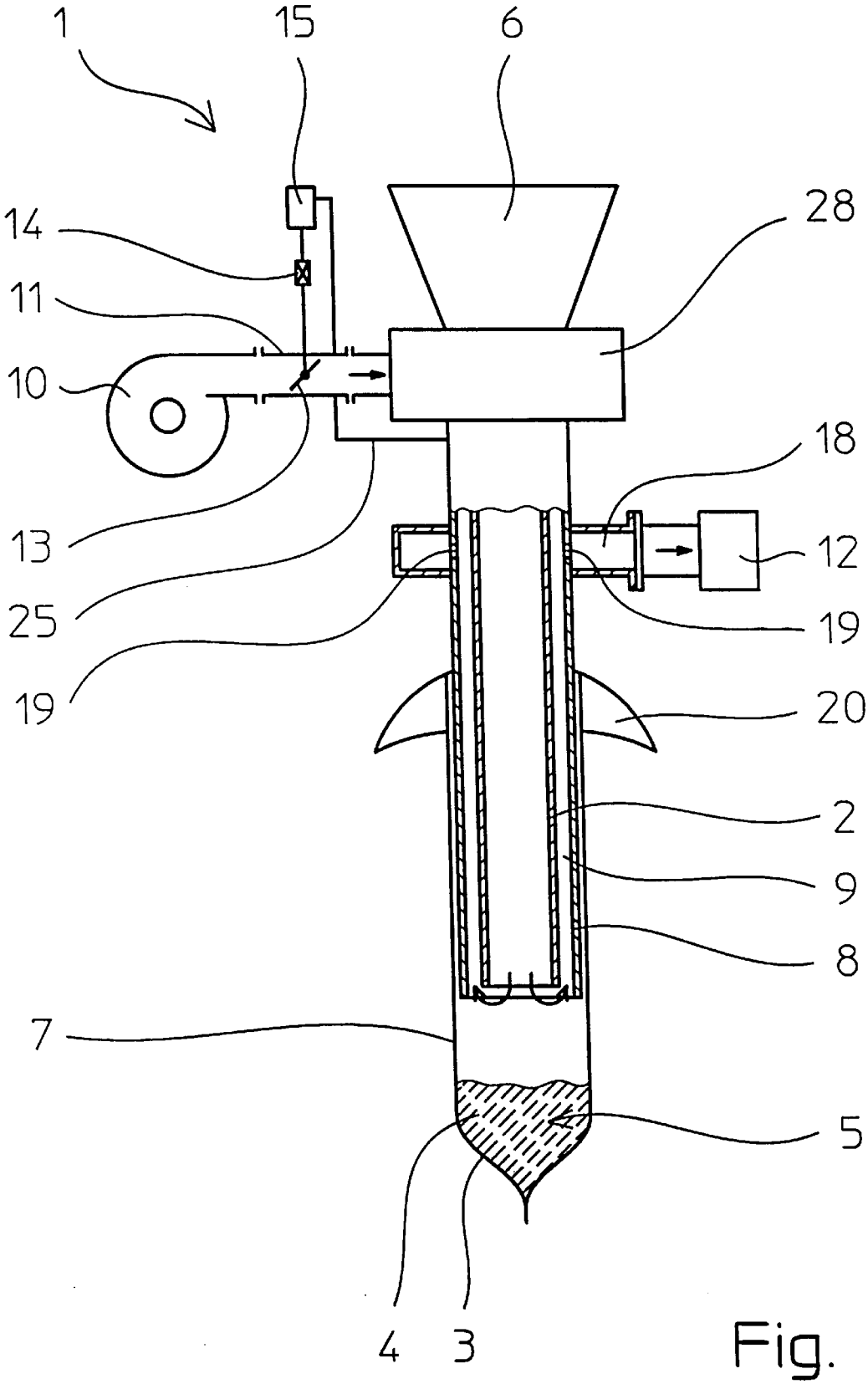
FIG. 1 is a side view with a partial vertical cross-sectional view of a device for packaging comprising a vertical fill pipe, a funnel above the fill pipe, a format pipe surrounding the fill pipe, wherein between the fill pipe and the format pipe there is provided an annular gap, a blower for introducing air into the fill pipe, a suction device for sucking air out of the annular gap, and an air flap in a pipe of the air supply line, wherein the air flap can be operated by means of a drive and a control device.
Figure 2:
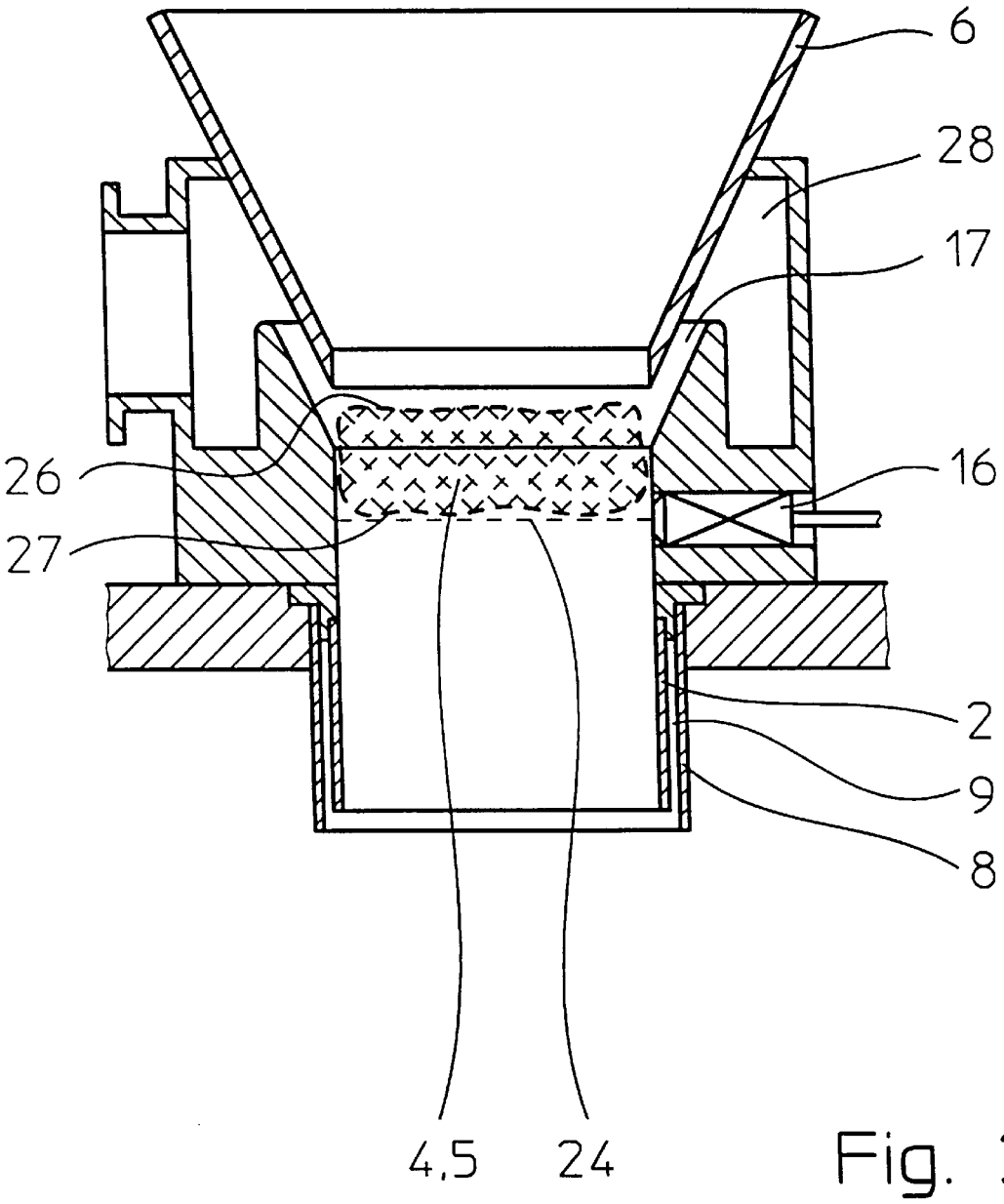
FIG. 2 is a vertical cross-sectional view of a portion of the subject matter of FIG. 1 comprising an annular nozzle between the funnel and the fill pipe, and comprising a sensor for recognizing a falling product.
Figure 3:
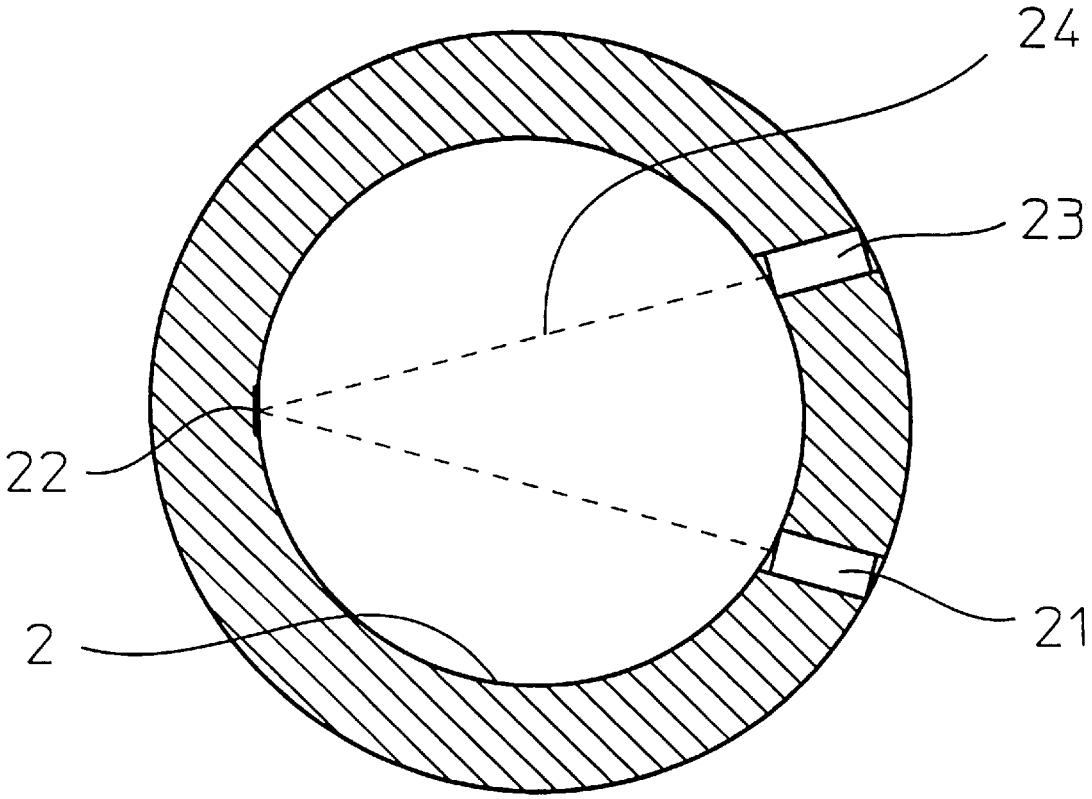
FIG. 3 is a horizontal cross-sectional view of the fill pipe and the sensor of FIG. 2, whereby the sensor is designed in accordance with a sensor/receiver principle.

A vertical fill pipe 2 for feeding a product portion and for filling a tubular bag 3 is provided in a device 1 for packaging. The product passes a funnel 6 and then falls then through the fill pipe 2 into the lower end of a longitudinally welded foil tube, which is then separated and welded in order to produce the tubular bag 3. A scale can be positioned above the funnel for measuring the amount of product therein, which scale can be electrically connected to a control device. The fill pipe 2 is concentrically surrounded by a format pipe 8, on which the foil tube 7 slides downwardly. An annular 5 gap 9 is provided between the fill pipe 2 and format pipe 8.

A blower 10 is used to blow air into the fill pipe 2 and to influence the product 4, which falls as a particle cluster, during the fall. The blower is connected to the fill pipe 2 through a pipe 11. A suction device 12 is used to suck the blown-in air out of the annular gap 9, into which the air moves from the lower end of the fill pipe 2.

An air flap 13 is provided within the pipe 11 of the air supply, which air flap can be operated by means of a drive 14 (e.g. servomotor, motor, solenoid, etc.). The drive 14 is connected to a control device 15 (e.g. computer, programmable logic controller, etc.), with which the air flap 13 is operated dependent on the point in time during which the product 4 passes a sensor 16. The control device 15 can include a numerical storage device (e.g. ROM, RAM, magnetic media, etc.) for storing empirical data relating to the product, packaging devices, etc.

The suction device 12 runs continuously during the timed opening and closing of the air flap 13. The blower 10 and the suction device 12 can be additionally driven independently from one another and both controlled by the control device 15. The suction device 12 can also suck off the air entering through the funnel since its performance is greater than the blower performance.

The pipe 11 ends in an annular nozzle 17, which is provided between the funnel 6 and the fill pipe 2, and which due to its alignment produces a downwardly directed (flowing) air stream.

The suction device 12 is connected to a suction chamber 18 enclosing the fill pipe 2, and the suction chamber 18 is in turn connected to the annular gap 9 through openings 19 in the format pipe 8. A forming shoulder 20 is provided on the format pipe 8 below (downstream) the suction chamber 18 so that the suction device does not interfere with the foil tube and its travel down the format pipe to feed foil and create foil bags.

The sensor 16 below the annular nozzle 17 includes a laser 21, a reflector 22 and a receiving diode 23, and recognizes the presence of product 4 by the laser beam 24 being interrupted by product travelling between the laser and receiver 21 and 23 and the reflector 22. The sensor 16 is electrically connected to the control device 15 through a electrically conducting line 25. The sensor 16 is preferably directly below (adjacent) the annular nozzle 17 upwardly of the forming shoulder 20.

The device 1 is operated such that a timed air stream is fed through an annular chamber 28 to the fill pipe 2 by a timed operation of the air flap 13. The air flap 13 is operated dependent on the falling position of the product 4. The air flap 13 is always opened when product 4 is registered by the sensor 16 and is again closed after a specified time after product passes the sensor 16, which causes the air stream to compress the particle cluster of the product 4 and to additionally accelerate same downwardly.

An air pressure increase occurs above the upper cluster end 26 (end) of the product 4 so that the lower cluster end 26 (start) is blown closer to the lower cluster start 27, and the product cluster is thus more compressed and thus can be filled more quickly into a bag.

The blower performance and the suction performance are adjusted such that a specific inside pressure exists in the lower end of the foil tube 7, which inside pressure provides an inflated tubular bag 3.

Although a particular preferred embodiment of the invention is disclosed in detail for illustrative purposes, it is recognized that variations or modifications of the disclosed apparatus, including the rearrangement of parts, lie within the scope of the present invention.

What is claimed is:

1. In a device for packaging including a vertically aligned fill pipe, a funnel for feeding a fill material into the fill pipe, a forming shoulder for shaping a sheet into a tube to be filled, whereby the tube surrounds the fill pipe, an annular nozzle defined in a space between the funnel and one end of the fill pipe, and a blower device connected to the annular nozzle through a supply pipeline for producing an air flow in order to create a downward air flow in the fill pipe, which air flow entrains the fill material to enable quick movement thereof through the fill pipe into the tube, a format pipe surrounding said fill pipe with an annular gap therebetween and providing a sliding support for the tube that encircles it, the air flow and entrained fill material moving downwardly throughout the length of said fill pipe, and a suction device for removing the air flow from the tube and the lower end of said fill pipe through the gap, the improvement wherein an air flap is positioned within the supply pipeline and movable through plural positions to provide restricted and unrestricted air flow therethrough, and a drive mechanism connected to the air flap for effecting operable driving movement of the air flap through the plural positions to provide a selected air flow to the annular nozzle and thence directly to the one end of the fill pipe.

2. The device according to claim 1, wherein the blower device and the suction device are operated independently from one another.

3. The device according to claim 1, wherein the supply pipeline terminates at an annular nozzle provided between the funnel and the one end of the fill pipe, and which can produce a downwardly directed air stream inside the fill pipe.

4. The device according to claim 1, wherein the suction device is connected to a suction chamber provided on the format pipe, and the suction chamber is connected to the annular gap through openings in the format pipe.

5. The device according to claim 1, wherein a forming shoulder is provided on the format pipe below the suction chamber.

6. The device according to claim 1, wherein a sensor for recognizing the falling product is provided in the fill pipe.

7. The device according to claim 6, wherein the sensor is positioned on the fill pipe directly below the annular nozzle.

8. The device according to claim 6, wherein the sensor is connected to at least one of a control device for controlling drive mechanism, a packaging machine drive, a scale provided above the funnel, the blower, and the suction device.

9. The device according to claim 1, wherein the fill pipe and the format pipe are open at bottoms thereof, and a space between the fill pipe and the format pipe is connected to said suction device for vacuuming off air in the annular gap.

10. A method for operating a device for packaging which includes a vertical fill pipe, a funnel above the fill pipe, a format pipe concentrically surrounding the fill pipe, an annular gap defined between the fill pipe and the format pipe, a blower for blowing air into an upper end of the fill pipe and, for influencing the falling product in the fill pipe, an air supply pipe is connected to the blower to the fill pipe for supplying the air thereto, a suction device for sucking the air out of a lower end of the fill pipe, an air flap positioned within the air supply pipe, a drive connected to said air flap for operating said air flap; and a control device connected to said drive for controlling the same comprising the step of operating the air flap to supply a timed air stream to the upper end of the fill pipe, or adjusting the air flap to a passage position in order to supply a continuous air stream to the upper end of the fill pipe and compressing the product cluster by controlling at least one of the blower device, air flap, and suction device.

11. A method according to claim 10, wherein the step of operating includes operating the air flap dependent on a least one of the product, the portion mass of the product, and a falling time of the product.

12. The method according to claim 10, comprising the steps of filling the product into a foil tube, and operating one of the air flap and the suction device dependent on the pressure desired in the lower end of the foil tube.

13. The method according to claim 10, comprising the step of accelerating a product portion falling in the fill pipe by suitable control of at least one of the blower device, the air flap, and the suction device, and the product portion is pulled apart by an air flow increase below a lower cluster end of the product.

14. The method according to claim 10, comprising the step of pulling the product cluster apart by controlling at least one of the blower device, air flap, and suction device so as to create an air flow increase below a lower product cluster end relative to the air flow above an upper product cluster end.

15. The method according to claim 10, comprising the step of continuously operating the suction device.

* * * * *